US005470439A

United States Patent [19]

Makino et al.

[11] Patent Number: 5,470,439

[45] Date of Patent: Nov. 28, 1995

[54] END PORTION FLOW RATE REGULATING APPARATUS FOR A PAPER MACHINE HEADBOX

[75] Inventors: Tetsuo Makino; Keiichi Fujiki, both of Mihara; Toshimi Tajima, Hiroshima, all of Japan

[73] Assignee: Mitsubishi Jukogyo Kabushiki Kaisha, Tokyo, Japan

[21] Appl. No.: 142,138

[22] Filed: Oct. 28, 1993

[30] Foreign Application Priority Data

Oct. 29, 1992 [JP] Japan ..... 4-312670
Jan. 14, 1993 [JP] Japan ..... 5-020824

[51] Int. Cl.[6] ..... D21F 1/06

[52] U.S. Cl. ..... 162/216; 162/337; 162/259; 162/336

[58] Field of Search ..... 162/216, 259, 162/336, 337; 137/625.46, 625.47, 625.48

[56] References Cited

U.S. PATENT DOCUMENTS 4,888,094 12/1989 Weisshuhn et al. ..... 162/198
5,104,011 4/1992 Clarke-Pounder et al. ..... 222/504

FOREIGN PATENT DOCUMENTS 0232604 8/1987 European Pat. Off. .
0445564 9/1991 European Pat. Off. .
89/11561 11/1989 WIPO .

*Primary Examiner*—W. Gary Jones
*Assistant Examiner*—Calvin Padgett
*Attorney, Agent, or Firm*—Wenderoth, Lind & Ponack

[57] ABSTRACT

A flow rate regulating apparatus of a paper-making machine headbox is compact, can regulate the flow directions of jets of the wet paper stock during operation, and prevents stagnation. Each of tubes at ends of a tube bank disposed upstream of a slice chamber of the headbox for receiving stock from a tapered header includes a first tubular portion consisting of an inlet section having a small inner diameter, a take-out section protruding to the outside of the tube bank, and an outlet section contiguous to the take-out section, and a second tubular portion having a large inner diameter. The inner diameter of each take-out section is larger than the inner diameter of tubes located in the central portion of the tube bank. The take-out sections are provided with a flow rate regulating valve and a flow meter. Alternatively, the end tubes each have a first tubular portion that is straight, and a second tubular portion having a larger inner diameter than and disposed coaxially with the first tubular portion. The inner diameters of the first tubular portions of the end tubes are larger than the corresponding portions of the central tubes. Paper webs having various properties can be made by changing the flow rates of stock flowing through the end tubes with the flow rate regulating valves.

5 Claims, 9 Drawing Sheets

END PORTION FLOW RATE REGULATING APPARATUS FOR A PAPER MACHINE HEADBOX

BACKGROUND OF THE INVENTION

1. Field of the Invention

The present invention relates to an end portion flow rate regulating apparatus for a paper-making machine headbox, in which wet paper stock is led from a tapered header through a tube bank to a slice chamber.

2. Description of the Prior Art

While computer paper is being stacked up after printing, sometimes the phenomena called "oblique tilt" occurs, wherein the paper layers stack up obliquely and slip a little one upon the other. Also, copy sheets would curl, and sometimes a sorter would stop due to problems with the paper. The principal causes of these troubles are considered to be fiber orientation angles of the paper or a difference of the fiber orientation angles between the respective sides of the paper. In general, in a machine-made paper sheet, many long and slender fibers are aligned in the paper making direction (MD). Therefore, the mechanical strength of the paper in the paper making direction (MD) is normally at least twice that in a cross direction (CD) of the machine extending at right angles to the paper making direction.

Although the direction of orientation of most of the fibers nearly coincides with the paper making direction, the orientation of the fibers of portions of the paper web made at sides of the machine (principal axis of fiber orientation) deviates slightly from the MD direction of the machine. This deviation is referred to as the "fiber orientation angle", and when this angle is large the paper is said to have a "poor fiber orientation property".

Although the fiber orientation angle can be determined from the measured tensile strength of a paper sheet, it is also possible to accurately measure the fiber orientation angle in a short period of time by using a measuring instrument called an SST (Sonic Sheet Tester). The SST makes use of the fact that normally the speed of a supersonic wave propagating through paper is high in the principal direction of alignment of the fibers.

If the direction of a jet ejected from a headbox includes a CD (cross-directional) component, then the fiber orientation deviates from the MD direction. If this deviation is great, a paper web having a poor fiber orientation is produced. Accordingly, a headbox which ejects jets having a small CD component is required.

In general, in order to eliminate the phenomena of "oblique tilt", the fiber orientation angle must be 2° or less. Also, it is known that in a paper sheet having a little curl a difference between the fiber orientation angles at the front and rear sides of the paper sheet is small.

In this regard, U.S. Pat. No. 2,904,461 proposes means for injecting fluid from side plates (pond sides) of an air-cushioned headbox. Also, Japanese Patent Publication No. 43-12602 (1968) discloses bleed means for extracting liquid from side plates of an air-cushioned headbox. However, in these known apparatus, flow resistance at the sides of the air-cushioned headbox was increased due to a rectifying roll and the wall surfaces of the pond sides. As a result, the flow velocity is lowered just in front of a jet port of a slice. Hence, the flow directions of the jets vary, and (1) the basis weight of the paper at the sides of the wires becomes too low and (2) an uneven portion having a large basis weight is produced at locations just a little inside of the pond sides.

The above-described reference did disclose the concepts of enhancing the uniformity of the basis of the paper weight by injecting or extracting liquid to or from the sides of the headbox. In a subsequently developed hydraulic headbox not having a rectifying roll, sometimes there was a tendency to generate a similar uneven basis weight due to deficiencies associated with an end portion porosity of a tube bank and resistance offered by wall surfaces of the pond sides of the headbox. In addition, even if the basis weight were sufficiently uniform, if the paper making was effected under a ratio J/W (jet velocity to the wire velocity) of close to 1.00, then sometimes a component of the force on the stock in the CD direction became excessive and the fiber orientation angle became about 5°–10°.

FIGS. 14 to 16 show one example of a hydraulic headbox in the prior art. Stock flows through a circular-to-rectangular transition approach pipe 1, then flows into a thin-tipped tapered header 2 having a rectangular section, and is divided into tubes 4 aligned in the widthwise direction of a tube bank 3. In addition, part of the stock in the header flows to recirculation piping 20. Reference numeral 19 designates a valve and numeral 21 designates a flow meter. An inlet portion 4' of each tube 4 has a small diameter in order to enhance the uniformity of the distribution of the flow rate in the widthwise direction, and the velocity of the flow is raised in this portion, whereby head loss increases.

Furthermore, an outlet portion 4" of each tube 4 has a larger cross-sectional area to lower the velocity of the flow for the purpose of preventing the velocity of the flow entering a slice chamber 5 from becoming excessive. The slice chamber 5 is divided in the vertical direction by sheet-like flow-suppressor elements 6 extending in the widthwise direction of the headbox. Thus, jets ejected from the tubes 4 are suppressed from mixing and establishing a large mass. Disturbance of the flow is limited by the flow-suppressor elements 6 to an extent corresponding to the intervals between the sheet-like elements. Also, since a shearing force is applied to the fluid, a state of dispersion of the fibers is greatly improved.

Accordingly, a smooth jet in which disturbance is small and the dispersion of fibers is excellent, is obtained. In addition, a top plate 7 and a bottom plate 8 of the slice chamber 5 converge in the direction of flow, and the top plate 7 can rotate about a pivot 10 to adjust the size of an ejection port 11 of the headbox. The size of the ejection port can be finely adjusted by flexing a lip 9 of the top plate 7 over the entire widthwise direction of the chambers. Reference numeral 18 designates piping for regulating the flow rate by bleeding wet paper stock from the pond sides. As the amount of stock so extracted increases, the more the jet begins to flow in the outward direction. During operation, the jets are preliminarily established to flow in inward directions by making the flow rates in the end tubes of the tube bank greater than the flow rates in the central tubes either by making the diameters of the end tubes larger than those of the central tubes or by providing end tubes at a pitch larger than that of the central tubes. The flow directions of the jets were regulated by appropriate bleeding of the stock through the piping 18.

FIG. 16 shows one example of the flow rate distributions in the widthwise direction of such a headbox. Although the orientation of the fibers presents no problem in ordinary paper, it was impossible to control the fiber orientation during operation. In addition, fluid was fed from inflow piping or recirculating piping in the heretofore known device for injecting fluid (wet paper stock) to the sides of a headbox. This resulted in a shortcoming in that if the recirculating flow rate is changed, then the flow rates at the end of the tube bank corresponding to the recirculating side would vary.

As described above, fluid is introduced into the end portion flow rate regulating apparatus in the prior art via inflow piping or recirculating piping. However, since these pipings are mounted at a location where the cross section of the flow path is changing, the flow rate of the fluid at that location is not identical to that in the header portion. On the basis of Bernoulli's theorem, therefore, the pressure (static pressure) of the fluid at such location is different from that in the header portion. In addition, the use of recirculating piping gave rise to the shortcoming that when the recirculating flow rate is regulated, the flow velocity change is comparatively greater, i.e. as compared to the use of inflow piping. Therefore, the pressure changes to a large extent. Furthermore, in the heretofore known method, although a stable fiber orientation can be obtained, it was impossible to widely control the fiber orientation during operation.

SUMMARY OF THE INVENTION

It is therefore one object of the present invention to provide an end portion flow rate regulating apparatus for a paper-making machine headbox, comprising a tube bank wherein piping leading wet paper stock to the sides of the slice chamber of the headbox is compact, and a flow regulating means by which flow directions of jets can be regulated during operation, and the flow of the stock will not stagnate nor will a flow of dregs be produced.

According to one aspect of the present invention, the tube bank of the flow rate regulating apparatus, which leads wet paper stock from a tapered header to a slice chamber of the headbox, has end tubes each including a first tubular portion consisting of an inlet section having a small inner diameter, and a take-out section, the inner diameter of the take-out sections being larger than the inner diameter of tubes disposed in the central portion of the tube bank between respective sets of the end tubes. The flow regulating means of the apparatus is operatively associated with the take-out sections of the end tubes.

Means for detecting a flow rate may be provided in the take-out sections, whereby the flow rate in the end tubes can be regulated based on conditions prevailing in the end tubes.

According to one feature of the present invention, tubes of the tube bank are vertically aligned. The flow regulating means is a valve including an integral block having a plurality of machined holes conformed to inner diameters of and disposed in-line with the passageways of the vertically aligned tubes, and a rotary shaft extending vertically in the block. During manufacture, the shaft is inserted into the block with a clearance fit established therebetween, the holes are machined in the block to form through-holes extending through the block and through portions of the shaft. The flow rate regulating valve is thus capable of simultaneously regulating the flow rates in the vertically aligned tubes by rotating the shaft.

According to an alternative form of the present invention, the end tubes of the tube bank each include a first small-diameter tubular portion that is straight a second larger-diameter tubular portion disposed coaxially with the first straight tubular portion, an inner diameter of each of the small-diameter tubular portions of the end tubes being larger than the inner diameters of small-diameter tubular portions of the central tubes of the tube bank. The end tubes are vertically aligned, and a flow rate regulating valve is provided for all of the first tubular portions of the vertically aligned end tubes of the tube bank, whereby the flow rates in each such set of vertically aligned end tubes can be simultaneously regulated.

According to the present invention, wet paper stock to be fed to the sides of the slice chamber of the headbox is led from the tapered header to the end tubes along with the stock for the central tubes. The tapered header has a rectangular cross section and is tapered in the widthwise direction of the machine, and is designed so that the flow velocity of the stock is uniform over the widthwise direction. According to Bernoulli's theorem, therefore, the static pressure is stable over the widthwise direction, and stable flow rates in the end tubes can be obtained. In addition, the end tubes have large inner diameters than the central tubes so that the stock flows at larger flow rates through the end tubes than through the central tubes. These flow rates can be regulated precisely and with a good reproducibility by the flow rate regulating valve. Therefore, the paper-making machine can manufacture paper sheets having good formation and yet exhibiting little oblique tilt and curl. Moreover, the lack of space restrictions makes it easy to install, inspect and perform maintenance on the valve. In addition, by providing a flow meter in the take-out sections of the end tubes, the flow rate in the end tubes can be precisely controlled.

Furthermore, the flow rate regulating valve is very compact. Therefore, such a valve can be provided not only in the end tubes but also in the second and third columns of tubes from the ends of the tube bank or even in all of the tubes, whereby a flow rate distribution can be regulated more effectively.

The above-mentioned and other objects, features and advantages of the present invention will become more apparent by referring to the following description of preferred embodiments of the invention made in conjunction with the accompanying drawings.

DETAILED DESCRIPTION OF THE PREFERRED EMBODIMENTS

Figure 1:
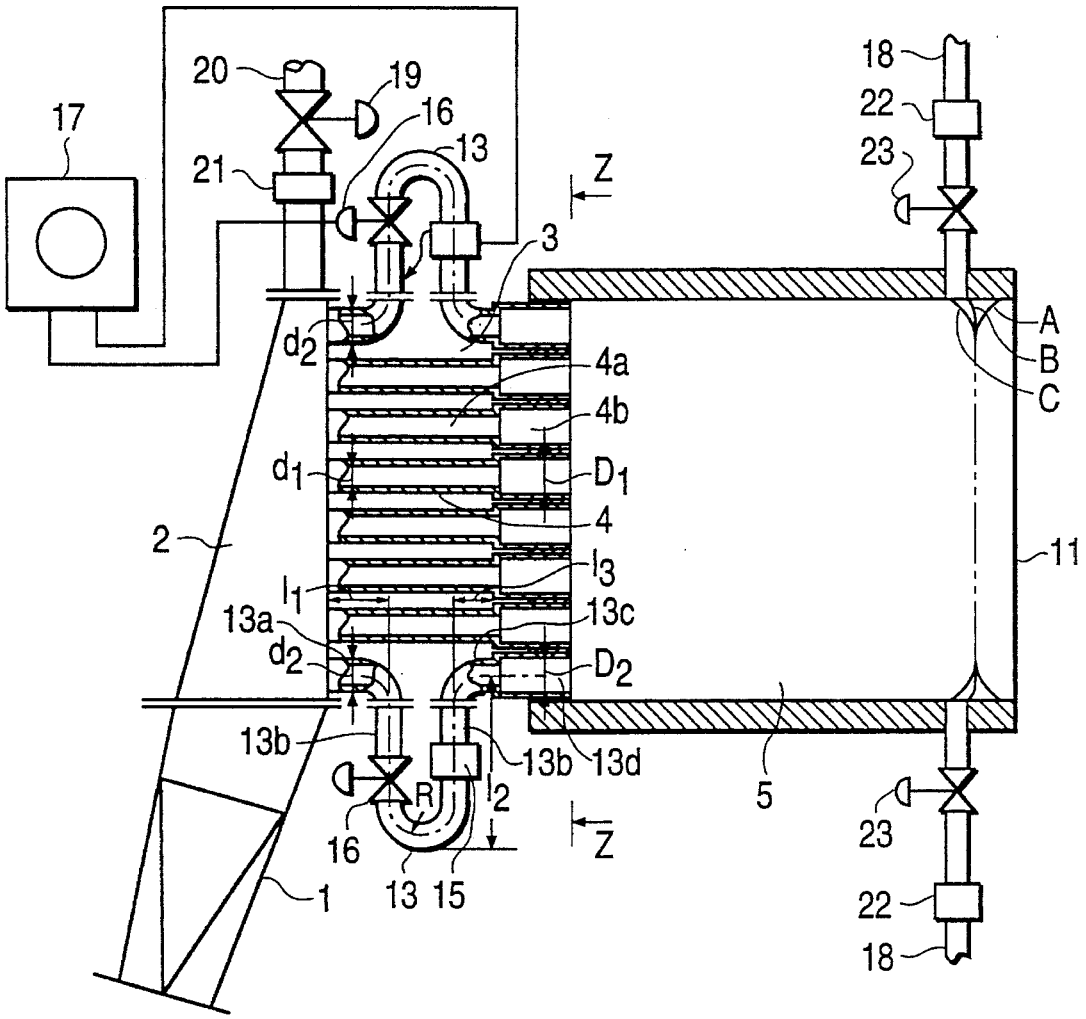
FIG. 1 is a horizontal cross-sectional view of a first embodiment of a flow rate regulating apparatus of a headbox of a paper-making machine according to the present invention.
Figure 2:
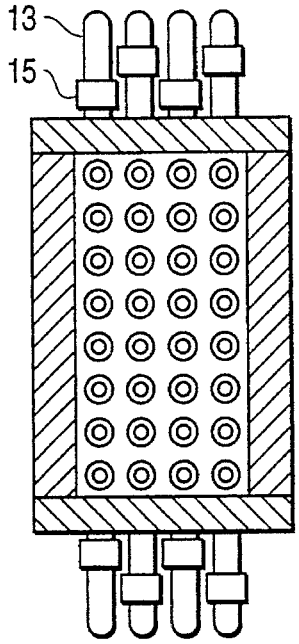
FIG. 2 is a vertical sectional view taken along line 2—2 in FIG. 1.
Figure 15:
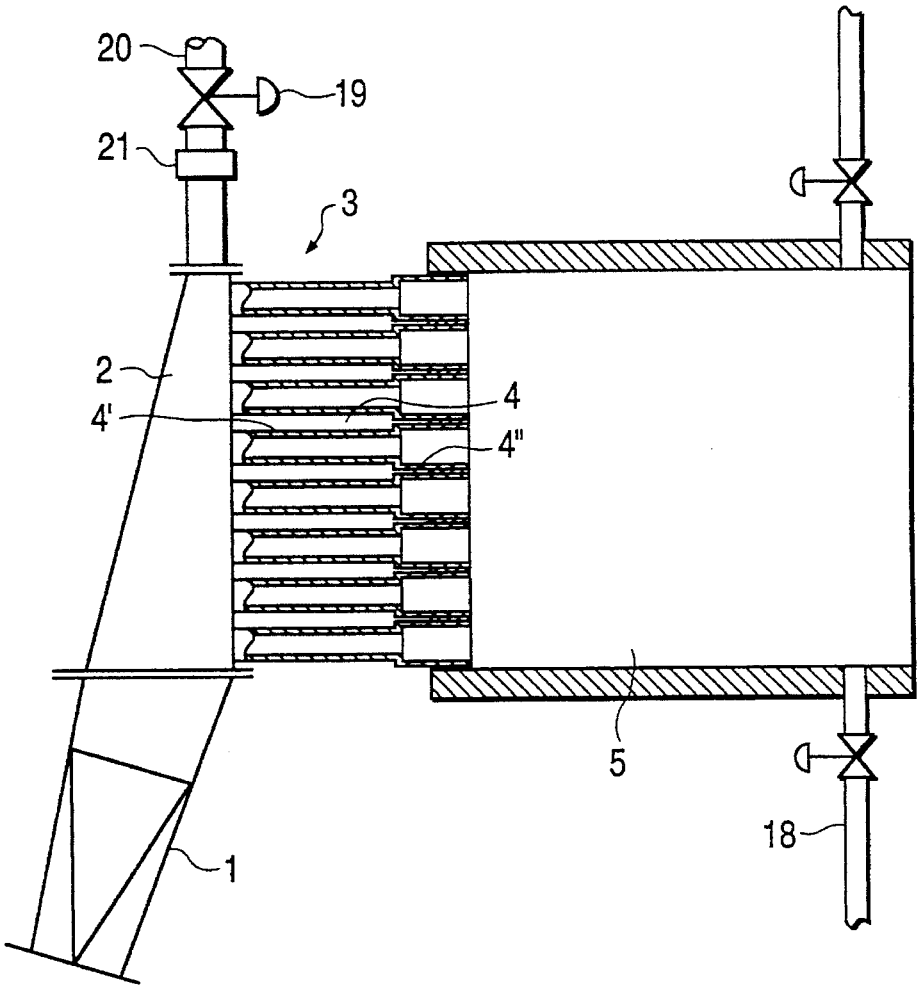
FIG. 15 is a horizontal cross-sectional view of the headbox of FIG. 14.
Figure 16:
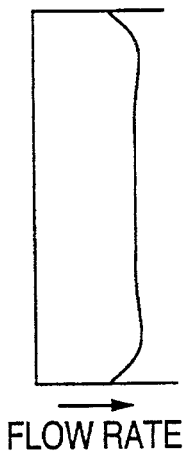
FIG. 16 is a diagram illustrating a flow rate distribution in a widthwise direction of a hydraulic headbox in the prior art.

In the following, preferred embodiments of the present invention will be described in greater detail with reference to the accompanying drawings. The structure shown in FIG. 1 is basically identical to the above-described structure in the prior art shown in FIG. 15 except that tubes 13 are provided at end portions of a tube bank 3. End tubes 13 and central tubes 4 are arrayed as columns of vertically aligned tubes on one side of a tapered header having a rectangular cross section. Each tube 4 includes a first tubular portion **4*a* which is long and has a small diameter and a second tubular portion 4*b*** which is short and has a larger diameter.

On the other hand, each end tube 13 has a U-shape which includes a first tubular portion consisting of an inlet section **13*a* having a small inner diameter $d_2$, a take-out section 13*b* and an outlet section 13*c*, and a second tubular portion 13*d* having a large inner diameter. The inlet section 13*a* of the first tubular portion of the end tube opens into the tapered header 2, whereby stock flowing through the tapered header 2 enters the inlet section 13*a*. A length $l_1$ of the inlet section 13*a* of the first tubular portion is preferably 3 $d_2$–5 $d_2$, wherein $d_2$ is the inner diameter of the inlet section 13*a*, but it could be longer. Further, the inner diameter $d_2$ of the inlet sections 13*a* of each of the first tubular portions are about 20%–60% larger than the inner diameters $d_1$ of each of the central tubes 4. It is to be noted that although the inlet section could be chamfered by about 1 mm, such is not necessary. Also, since each inlet of the central tubes 4 is defined by a sharp edge, if the inlet of each end tube 13 is chamfered or provided with a round, then head loss is reduced and the flow rate can be high. In addition, a projecting length $l_2$ of the take-out section is chosen to be 10 $d_2$–20 $d_2$, and a flow rate regulating valve 16 is provided in this take-out section 13*b*. For the flow regulating valve 16**, a ball valve or a V-port ball valve is preferred in view of preventing clogging.

In addition, a flow meter 15 is provided in the take-out section **13*b* to measure the flow rate. For the flow meter 15, an electromagnetic flow meter is preferred due to its precision. The inner diameter of the flow meter 15 is chosen to be identical to the inner diameter of the take-out section 13*b***, whereby clogging and excessive head loss are prevented. An elbow differential pressure type of flow meter or an across-valve differential pressure type of flow meter could be employed instead of an electromagnetic flow meter.

Furthermore, the lengths of vertically aligned channels of the end tubes 13 are identical. Accordingly, the head losses are identical. Thus, it is not necessary to measure flow rates in both of the channels of each take-out section **13*b*, thereby saving costs. Also, a radius of curvature R of an elbow of each take-out section 13*b* is about 2.5 $d_2$, and a length $l_3$ of the outlet section 13*c* of the first tubular portion is chosen to be at least 3 $d_2$ and preferably 10 $d_2$. It is to be noted that the inlet section 13*a* of the first tubular portion of the end tube 13, the outlet section 13*c* thereof and the second tubular portion 13*d* are disposed along the same axis, and that the inner diameter of the outlet section 13*c* is basically larger than the inner diameter of each of the central tubes 4. Accordingly, a head loss in the end tubes is smaller than that in the central tubes, and the flow rate in the end tubes is comparatively large. However, if a flow rate in the take-out section is maintained sufficiently low and the head loss is kept small, then the inner diameter of the outlet section 13*c* of the end tube could be made identical to the inner diameter of each of the central tubes 4**.

In the first preferred embodiment shown in FIG. 1, the flow rate of stock flowing through the end tube 13 can be regulated independently by the flow rate regulating valve 16. In addition, a signal generated by the flow meter 15 provided in the take-out section **13*b* of the end tube 13 is issued to a flow rate controller 17, which controls the flow rate regulating valve 16** to produce a preset flow rate.

Next, the operation of the first preferred embodiment will be described with reference to FIG. 1. Stock is discharged from parts of the tapered header 2, where flow velocities are uniform in the widthwise direction, to the end portion flow rate regulating apparatus. Because a pressure difference between the FR (operation side) and the BK (drive side) is normally 1% or less than the average pressure, this place is the most suitable location for obtaining a stable flow rate.

Since stock is also fed to the end tubes 13 and the central tubes 4 from parts of the tapered header 2 where the flow velocities are also uniform in the widthwise direction, flow velocity and pressure are stabilized. In addition, since the end tubes 13 have inner diameters larger than the inner diameters of the central tubes 4, stock flows at a higher flow rate through the end tubes 13. Hence, as will be described in more detail later, by regulating the flow rate of stock in the end tubes 13 and J/W, a cross-direction flow component (CD component) is eliminated in the jet ejected from the headbox, and a paper web having an excellent fiber orientation property can be obtained.

In FIG. 1, if the flow rate regulating valve 16 is adjusted, a flow velocity distribution of the jets ejected from the headbox can be changed. More specifically, if the flow rates are increased by opening the regulating valves 16, then as shown at A in FIG. 1, the flow velocities at the opposite sides of the slice chamber 5 become high. On the other hand, if the flow rates are decreased by closing the regulating valves 16, then as shown at C in FIG. 1 the flow velocities at the opposite sides of the slice chamber 5 become low. Accordingly, by appropriately adjusting the degree of opening of the regulating valves 16, a flow velocity distribution as shown at B which is close to an ideal distribution can be obtained.

Next, the reason why fiber orientation properties can be varied by the end portion flow rate regulating apparatus will be explained with particular reference to FIGS. 4 to 7.

Figure 4:
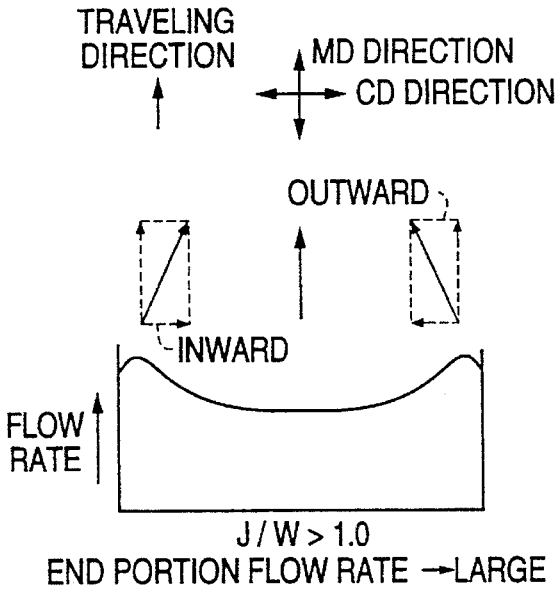
FIG. 4 is a diagram illustrating distributions of a flow rate and a flow direction in the widthwise direction of the headbox according to the present invention (J/W>1.0, end portion flow rate→large)
Figure 5:
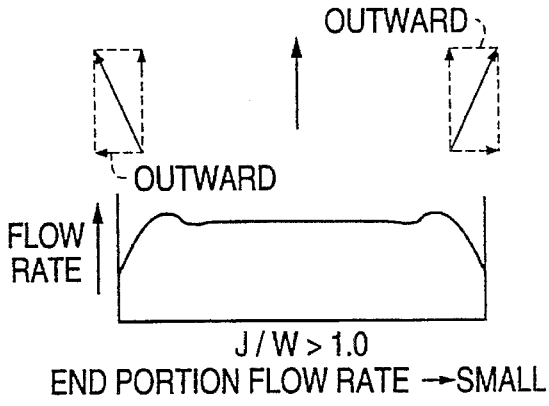
FIG. 5 is a diagram illustrating distributions of a flow rate and a flow direction in the widthwise direction of the headbox according to the present invention (J/W>1.0, end portion flow rate→small)

The flow rate of stock ejected from a headbox is reduced at opposite sides as shown in these figures due to friction generated between the stock and the side plates of the headbox Now, the directions of flow (flow directions represented by arrows) of stock, after the stock has been ejected from headbox jet ports and has landed on a wire, will be in the "traveling direction" of the wire in the case of J/W>1.00 because the stock moves faster than the wire as shown in FIGS. 4 and 5. In the case of J/W<1.00, the flow directions of the stock will be in the "opposite direction" to the traveling direction as pulled by the wire because the stock moves slower than the wire as shown in FIGS. 6 and 7.

Figure 6:
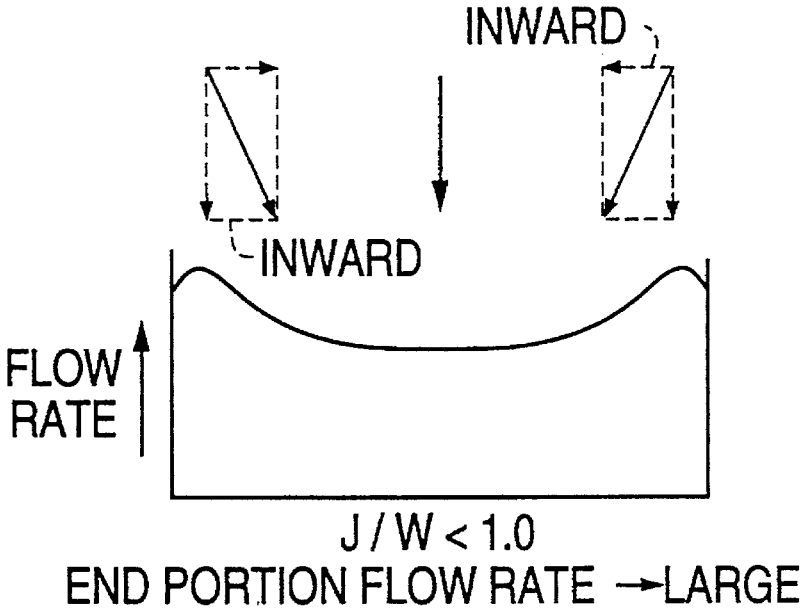
FIG. 6 is a diagram illustrating distributions of a flow rate and a flow direction in the widthwise direction of the headbox according to the present invention (J/W<1.0, end portion flow rate→large)

Now, if the flow rates in the end tubes 13 are made larger than the flow rates in the central tubes 4 (hereinafter referred to as "the end portion flow rate is large"), then the flow directions are skewed inward toward the longitudinal center of the wire, resulting in transverse flows as shown in FIGS. 4 and 6. On the contrary, if the flow rates in the end tubes 13 are made smaller than the flow rates in the central tubes 4 (hereinafter referred to as "the end portion flow rate is small"), then the flow directions are skewed outward, resulting in transverse flows as shown in FIGS. 5 and 7. Because the fibers of wet paper stock tend to align in the direction of flow, a paper web in which most of the fibers are aligned in the directions of the largest vectors shown in FIGS. 4 to 7 can be made.

Figure 7:
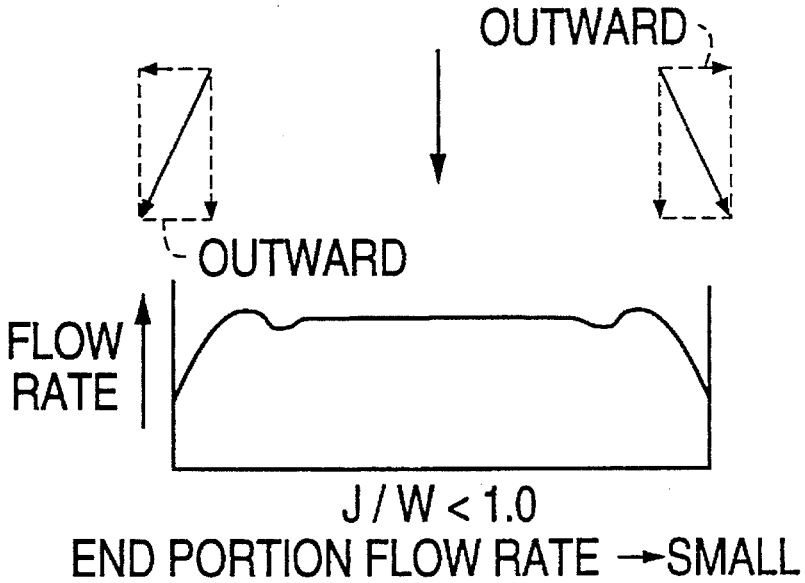
FIG. 7 is a diagram illustrating distributions of a flow rate and a flow direction in the widthwise direction of the headbox according to the present invention (J/W<1.0, end portion flow rate→small)

The orientations of fibers shown in FIGS. 4 and 7 are converging in the traveling direction such that when a paper web having such fiber orientations is being made, even if an ear portion of the paper web should tear a little, the paper web will not break because the tear will not propagate inwards. Therefore, such fiber orientations are extremely favorable in view of a production efficiency. Accordingly, a well-formed paper web having ear portions that are hardly torn can be made by selecting the conditions illustrated in FIG. 4.

Heretofore, in a headbox in which the end portion flow rate is small, in the case of making paper under the condition of J/W> 1.0, the fibers in ear portions were oriented in directions shown in FIG. 5 which allowed the ear portions to be broken easily. According to the present invention, the characteristics of paper and production efficiency can be taken into consideration in the making of paper having a desired fiber orientation property.

Thus, paper may be made according to a combination of four conditions as indicated in Table-1.

TABLE 1

| Corresponding FIG. | J/W | Flow rate in the end portion | Flow direction in the end portion | Paper property | Fiber orientation (along MD direction) | Paper strength of ear |
|---|---|---|---|---|---|---|
| FIG. 4 | >1.00 | large | inward | good formation | converging | hard to break |
| FIG. 5 | >1.00 | small | outward | good formation | diverging | easy to break |
| FIG. 6 | <1.00 | large | inward | little curl | diverging | easy to break |
| FIG. 7 | <1.00 | small | outward | little curl | converging | hard to break |

In general, in the case of J/W=1.00–1.02, formation is good, while in the case of J/W=0.97–1.00 a paper web having little curl can be obtained.

The end tubes 13 of the flow rate regulating apparatus of the present invention extend from the inlet sections 13*a* thereof to the outside of the tube bank 3 and then return inwardly to the outlet sections of the same tubes so that the apparatus can be equipped with the (electromagnetic) flow meters 15 and flow rate regulating valves 16 at locations which facilitate maintenance and inspection of these devices.

A second preferred embodiment of the present invention will now be described with reference to FIG. 3.

Figure 3:
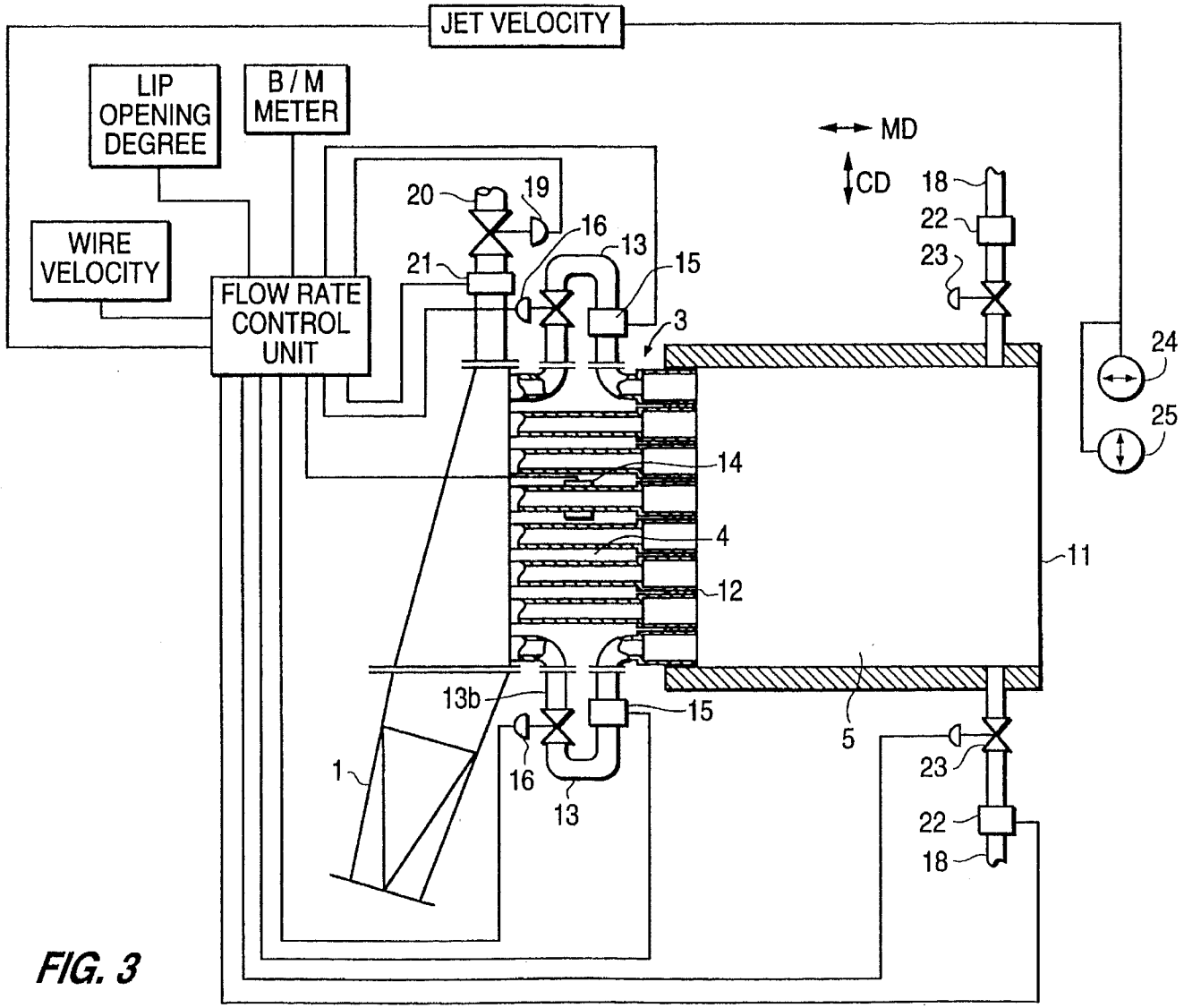
FIG. 3 is a horizontal cross-sectional view of a second embodiment of a flow rate regulating apparatus of a headbox according to the present invention.

A difference between the second preferred embodiment of FIG. 3 and the first preferred embodiment of FIG. 1 exists in that a flow rate detecting means 14 is provided on a central tube 4. In the second preferred embodiment by setting the flow rate in the end tubes 13 based on the flow rate in the central tubes 4, the flow rate at the sides of the headbox can be set in proportion to the flow rate at the central portion of the headbox.

Although a small electromagnetic flow meter or a differential pressure type of flow meter could be provided directly in the central tubes 4 as the central portion tube flow rate detecting means 14, it is also possible to determine the flow rate per unit of the central tubes by subtracting a recirculation flow rate from a flow rate of the inflow, and then subtracting flow rates in both sets of the end tubes form such a difference.

In this second preferred embodiment shown in FIG. 3, data such as the lip opening degree, wire velocity, cross-directional basis weight profile data measured by an on-machine basis weight scanner, and the like are input to a flow rate control unit, and the end portion flow rate is automatically set according to the prevailing paper-making conditions. In addition, a jet velocity meter 24 for MD-direction measurement of the velocity of a jet in a non-contact fashion and a jet velocity meter 25 for CD-direction measurement are provided.

The measured flow direction of the jet, and a recirculation flow rate, the end portion flow rate and a bleed flow rate are compositely controlled by the flow rate control unit. By regulating the recirculation flow rate, the flow direction of the jet, over the entire width of the headbox, is made to coincide with the MD-direction. The end portion flow rate is so regulated that a particular fiber orientation is imparted to the paper web. Furthermore, the flow direction just in front of an ejecting port is finely adjusted by regulating the bleed flow rate.

Figure 8:
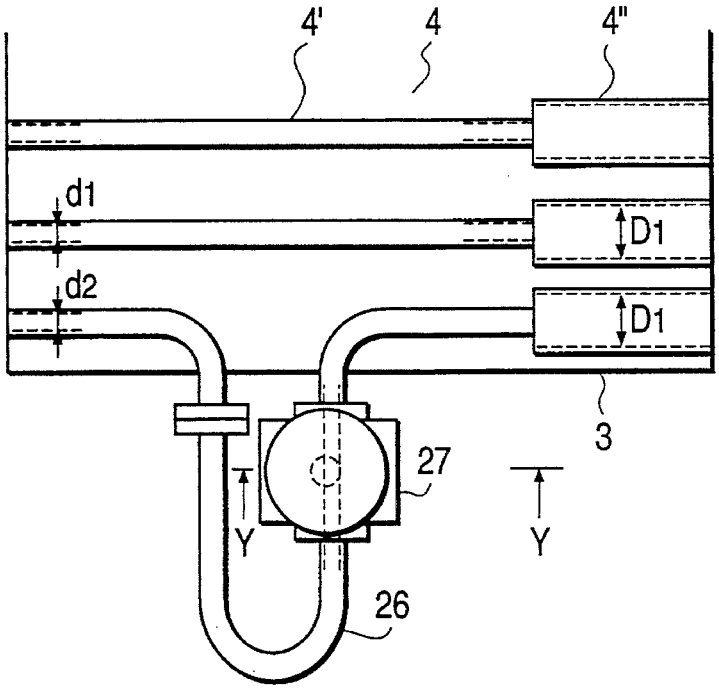
FIG. 8 is a plan view of an end portion tube of a third preferred embodiment of a flow rate regulating apparatus of a headbox according to the present invention.
Figure 9:
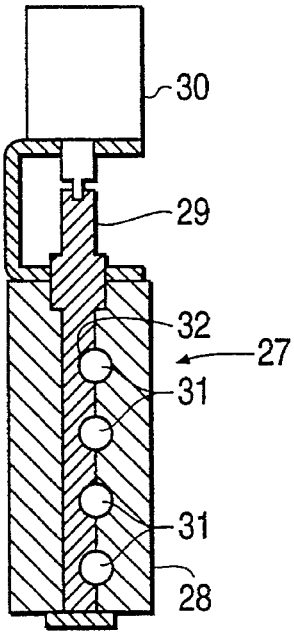
FIG. 9 is a cross-sectional view taken along line 9—9 in FIG. 8.

In a third preferred embodiment shown in FIGS. 8 and 9, four end tubes 26 are aligned in the vertical direction, and the rate at which stock flows through these four tubes 26 is regulated by a single flow rate regulating valve 27.

The flow rate regulating valve 27 includes an integral block 28, a shaft 29 and an electric motor unit 30. In addition as shown in FIG. 9, holes 31 aligned in a column extend partly into the block 28 and the shaft 29. Accordingly, the shaft 29 has notches 32. By rotating the shaft 29, a portion of the penetrating holes 31 are closed to regulate flow rates in the end tubes 26. It is to be noted that since it is unnecessary to reduce the flow rate to zero, the valve does not have to be able to fully close. In this third preferred embodiment shown in FIGS. 8 and 9, head loss is less than in the first preferred embodiment and the end portion flow rate can be made high, because the regulating apparatus is comparatively compact and the length of the takeout section is correspondingly short.

Figure 10:
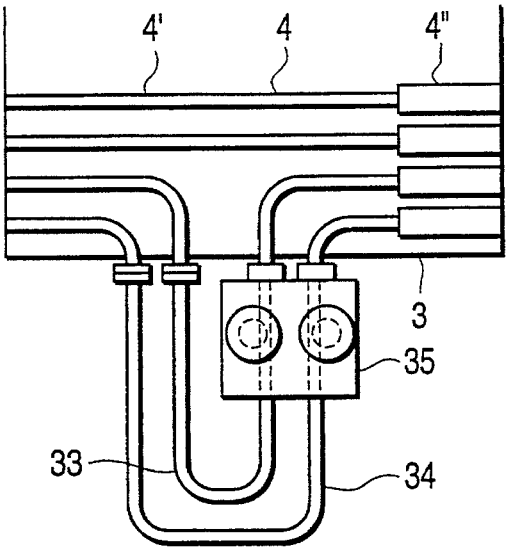
FIG. 10 is a plan view of end portion tubes of a fourth preferred embodiment of a flow rate regulating apparatus of a headbox according to the present invention.

A fourth preferred embodiment of the present invention is shown in FIG. 10. In this embodiment two kinds of end portion tubes 33 and 34 are provided at each end of the tube bank 3, and a flow rate regulating valve 35 is provided in the take-out sections of the tubes 33, 34. In this preferred embodiment, the end portion of the tube bank 3 where the flow rate is regulated is broad as compared to the above-described first, second and third preferred embodiments.

The above-described first to fourth preferred embodiments all provided an end portion flow rate regulating apparatus for a paper-making machine headbox characterized in that (1) a tubular portion of the end tube includes a small-diameter inlet section, a take-out section extending from the inlet section to the outside of the tube bank, and a small-diameter outlet section, (2) the inner diameter of the take-out section is larger than the inner diameter of the central tubes, and (3) a flow rate regulating means is provided in the take-out section.

Figure 11:
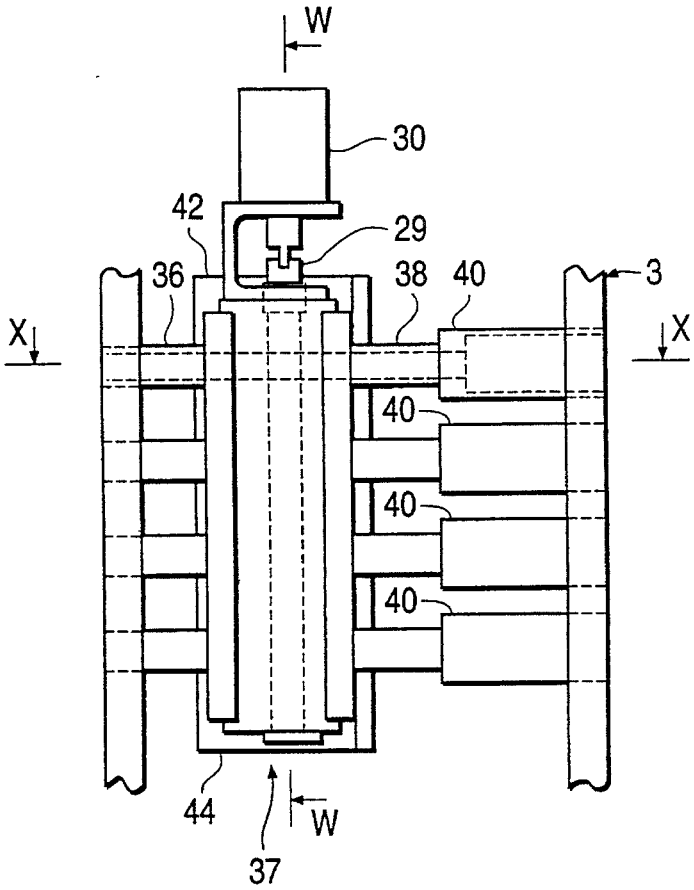
FIG. 11 is a front view of end portion tubes of a fifth preferred embodiment of a flow rate regulating apparatus of a headbox according to the present invention.
Figure 12:
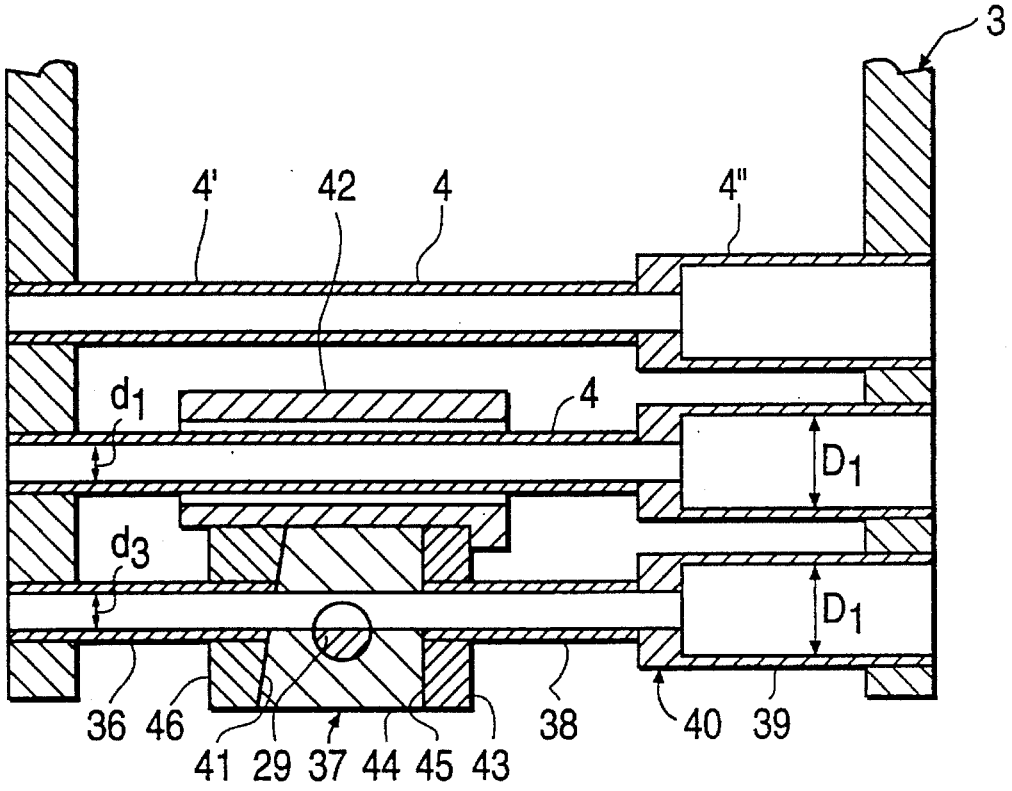
FIG. 12 is a cross-sectional view taken along line 12—12 in FIG. 11.
Figure 13:
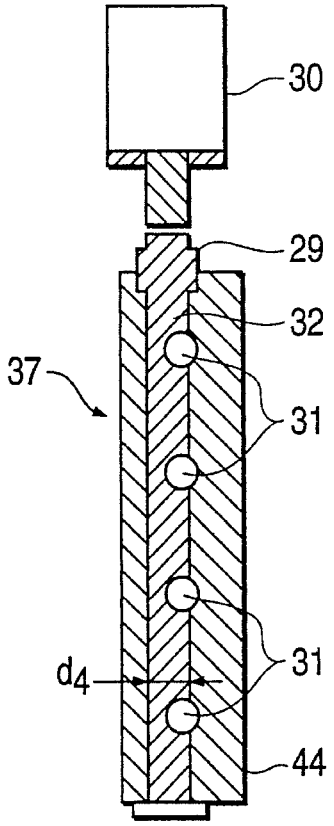
FIG. 13 is a cross-sectional view taken along line 13—13 in FIG. 11.
Figure 14:
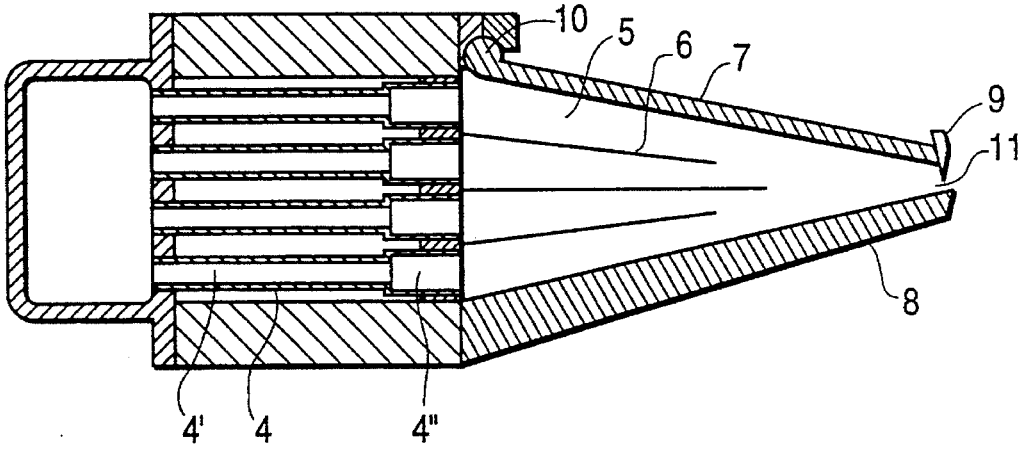
FIG. 14 is a vertical sectional view of a headbox in the prior art.

FIGS. 11 to 13 illustrate a fifth preferred embodiment of the present invention.

The fifth preferred embodiment of the present invention makes use of the flow rate regulating valve of the third preferred embodiment shown in FIG. 8. The flow rates in a plurality of tubes aligned vertically can be simultaneously adjusted by the single shaft of this flow regulating valve.

Referring to FIG. 11, flow rate adjustment in four vertically aligned end tubes 40 is carried out by a single flow rate regulating valve 37.

As shown in FIG. 12, this flow rate regulating valve 37 is provided midway of a small-diameter first tubular portion of the end tube 40. Also, the respective bores in a pipe 36 of the first tubular portion, the flow rate regulating valve 37 and a pipe 38 of the first tubular portion have the same inner diameter $d_3$, and these bores are disposed coaxially. It is to be noted that the inner diameter $d_3$ of the first tubular portion of the end tube 40 is larger than the inner diameter $d_1$ of the central tube 4, and preferably $d_3=1.1–1.5\ d_1$.

Reference numeral 42 designates a sheet-like member bonded to a main body of the tube bank 3. In addition, the pipes 36 and a flange 46 are assembled in the tube bank 3 after being fixed to one another. Likewise, the pipes 38, pipes 39 of the second tubular portions of the end tubes 40 and a flange 43 are also assembled in the tube bank after having been fixedly secured to one another.

In addition, as shown in FIG. 13, the flow rate regulating valve 37 includes an integral block 44, a shaft 29 and an electric motor unit 30, and it is detachably assembled to the sheet member 42 by bolts.

In this case, the shaft 29 is inserted into the block 44, and a plurality of aligned through-holes 31 are drilled as shown in FIG. 13. The holes 31 pass through parts of the shaft 20 and through the block 44. Accordingly, notches 32 are formed in parts of the shaft 29.

By rotating the shaft 29, the through-holes 31 are partly blocked, whereby the rates at which stock flows through the end tubes 40 aligned in the vertical direction are simultaneously adjusted. Thus, the flow rates may be regulated. Since there is no need to reduce the flow rates to zero, the valve does not have to be able to close fully. In one experiment conducted by the inventors, a shaft diameter of $d_4=1.5\ d_3$ and an offset between center axes of the holes 31 and the center axis of the shaft 29 equal to $0.5\ d_3$ were employed. However, the present invention is not limited to such values.

Also, as shown in FIG. 12, one surface 41 of the block 44 extends obliquely to the opposite surface 45 of the block 44 so that the block 44, i.e. the flow rate regulating valve 37, can be easily mounted to and unmounted from sheet member 42.

As described in detail above, according to the present invention, even if a recirculation flow rate or an ejection flow rate of the headbox varies, pressure and flow rates of stock at the pond sides of the headbox can be stabilized. In addition, the take-out sections of the end tubes wherein the flow rates are regulated are compact and economical to produce, and yet stock will not stagnate therein. Moreover, the number of end tubes is less than the number of the central tubes or allow a lot of stock to flow therethrough. This allows the flow directions of the jets in the end tubes to be regulated so that the fibers may be aligned with the flow direction of the paper-making machine. Accordingly, a paper web having improved fiber orientation can be produced. Also, the end tubes project (embodiments of FIGS. 1–3 and 8–10) to the outside of the tube bank so that a flow rate regulating valve and a flow meter can be mounted thereto if it is necessary, to measure the flow rate and precisely control the flow rate. This feature also facilitates the maintenance of the end tubes.

The present invention also provides a more compact end portion flow rate regulating apparatus of a paper-making machine headbox in which the end tubes do not project to the outside of the tube bank but are straight (embodiment of FIGS. 11–13). In this case, the end tubes of the tube bank can be about 50 mm long in contrast to a length of about 300 mm for the end tubes which project to the outside of the tube bank.

Moreover, because the flow rate regulating valve of the present invention is in itself very compact, not only can the valve be applied to only the end tubes in order to regulate the flow rate in the end portions of the tube bank, the valve can be applied to both the end tubes and to the tubes in the second and third columns from the end portions or can be applied to all of the tubes of the tube bank in order to regulate the flow rate distribution over the entire width of the headbox.

While a principle of the present invention has been describes above in connection with a number of preferred embodiments, it is intended that all matter contained in the above description and shown in the accompanying drawings be interpreted as illustrative of the present invention and not in a limiting sense.

What is claimed is:

1. A paper-making machine headbox comprising: a tapered header; a slice chamber; and an end portion flow rate regulating apparatus comprising a tube bank disposed between said tapered header and said slice chamber, and flow regulating means for regulating the flow of wet paper stock through the tube bank to said slice chamber, said tube bank including two sets of vertically aligned end tubes and an array of central tubes interposed between said sets of end tubes, each of said end tubes having a tubular portion including an inlet section adjacent said tapered header, a take-out section extending contiguously from said inlet section and projecting to the outside of said tube bank, and an outlet section extending contiguously from said take-out section toward a respective side of said slice chamber, the inner diameter of the take-out section of the tubular portion of each of said end tubes being larger than the inner diameter of each of said central tubes, and said flow regulating means comprising valves associated with said sets of end tubes, respectively, each of said valves including an integral block having a plurality of through-holes disposed in-line with passageways of the take-out sections, respectively, of the end tubes of a respective one of said sets of vertically aligned end tubes, and a shaft extending vertically in said block and rotatably supported therein, said holes extending through portions of said shaft, such that the rates at which wet paper stock flows through said holes disposed in-line with the passageways of the take-out sections of the end tubes of each of said sets of vertically aligned end tubes are simultaneously adjustable by rotating the shaft of the valve associated therewith.

2. A paper-making machine headbox as claimed in claim 1 and further comprising detecting means for detecting the flow rate of paper stock, said detecting means being provided in each of the take-out sections of the tubular portions of said end tubes.

3. A paper-making machine headbox as claimed in claim 1 wherein the take-out section of each of said end tubes is U-shaped.

4. A paper-making machine headbox comprising: a tapered header; a slice chamber; and an end portion flow rate regulating apparatus comprising a tube bank disposed between said tapered header and said slice chamber, and flow regulating means for regulating the flow of wet paper stock through the tube bank to said slice chamber, said tube bank including two sets of vertically aligned end tubes and an array of central tubes interposed between said sets of end tubes, each of said end tubes having a first tubular portion that is straight and a second tubular portion disposed coaxially with said first tubular portion and extending in a direction therefrom toward said slice chamber, said second tubular portion having an inner diameter larger than that of the inner diameter of said first tubular portion, and the inner diameter of said first tubular portion of each of said end tubes being larger than the inner diameter of each of said central tubes, and said flow regulating means comprising valves associated with said sets of end tubes, respectively, each of said valves including an integral block having a plurality of through-holes disposed in-line with passageways of the first tubular portions, respectively, of the end tubes of a respective one of said sets of vertically aligned end tubes, and a shaft extending vertically in said block and rotatably supported therein, said holes extending through portions of said shaft, such that the rates at which wet paper stock flow through said holes disposed in-line with the passageways of the first tubular portions of the end tubes of each of said sets of vertically aligned end tubes are simultaneously adjustable by rotating the shaft of the valve associated therewith.

5. A paper-making machine headbox comprising: a tapered header; a slice chamber; and an end portion flow rate regulating apparatus comprising a tube bank disposed between said tapered header and said slice chamber, and flow regulating means for regulating the flow of wet paper stock through the tube bank to said slice chamber, said tube bank including two sets of vertically aligned end tubes and an array of central tubes interposed between said sets of end tubes, each of said end tubes having a tubular portion including an inlet section adjacent said tapered header, a U-shaped take-out section projecting to the outside of the tube bank and extending contiguously from said inlet section, and an outlet section extending contiguously from said take-out section toward a respective side of said slice chamber, the inner diameter of the take-out section of the tubular portion of each of said end tubes being larger than the inner diameter of each of said central tubes.

* * * * *